US010960425B2

(12) United States Patent
Kaiser et al.

(10) Patent No.: US 10,960,425 B2
(45) Date of Patent: Mar. 30, 2021

(54) MECHANISM FOR DELIVERING HIGHLY VISCOUS MATERIALS FOR COATING AN INTERIOR SURFACE OF A TUBULAR SUBSTRATE

(71) Applicant: G.P. Reeves Inc., Holland, MI (US)

(72) Inventors: Brian Kaiser, Grand Haven, MI (US); Kirk Brink, Holland, MI (US)

(73) Assignee: G.P. Reeves Inc., Holland, MI (US)

( * ) Notice: Subject to any disclaimer, the term of this patent is extended or adjusted under 35 U.S.C. 154(b) by 9 days.

(21) Appl. No.: 16/292,636

(22) Filed: Mar. 5, 2019

(65) Prior Publication Data

US 2020/0282419 A1 Sep. 10, 2020

(51) Int. Cl.
*B05B 13/06* (2006.01)
*B05B 3/10* (2006.01)

(52) U.S. Cl.
CPC ..... *B05B 13/0636* (2013.01); *B05B 3/1028* (2013.01); *B05B 3/1057* (2013.01)

(58) Field of Classification Search
USPC ..... 118/306, 317, 323; 239/223, 224; 427/236
See application file for complete search history.

(56) References Cited

U.S. PATENT DOCUMENTS

| | | | |
|---|---|---|---|
| 2,508,709 | A | 5/1950 | Goetchius |
| 2,827,009 | A | 3/1958 | Norris |
| 3,034,729 | A | 5/1962 | Gray et al. |
| 3,044,441 | A | 7/1962 | Blakeslee et al. |
| 3,459,586 | A | 8/1969 | Kiwiet et al. |
| 3,719,168 | A | 3/1973 | Kazee |
| 5,092,265 | A | 3/1992 | Hughes et al. |
| 5,385,752 | A | 1/1995 | Steele |
| 5,415,692 | A | 5/1995 | Fujita et al. |
| 5,452,853 | A | 9/1995 | Shook et al. |
| 6,095,431 | A | 8/2000 | Kiest, Sr. |
| 7,765,696 | B2 | 8/2010 | Maier et al. |
| 9,261,232 | B2 | 2/2016 | Belik |
| 2012/0067967 | A1 | 3/2012 | Delden et al. |

FOREIGN PATENT DOCUMENTS

| | | |
|---|---|---|
| EP | 0145266 | 6/1985 |
| EP | 0338222 | 10/1989 |
| EP | 0781606 | 7/1997 |
| WO | 2007006325 | 1/2007 |
| WO | 2017050436 | 3/2017 |

*Primary Examiner* — Yewebdar T Tadesse
(74) *Attorney, Agent, or Firm* — Price Heneveld LLP

(57) ABSTRACT

A material delivery assembly includes a delivery fitting attached to a drive shaft and including an outer wall that extends perpendicularly from a receiving surface. Apportioning slots are defined within the outer wall. A dispersion chamber is defined within the outer wall and the receiving surface. A material delivery conduit extends to a delivery port located within the dispersion chamber and is proximate the receiving surface of the delivery fitting. The material delivery port selectively delivers a viscous material to the receiving surface. The drive shaft and the delivery fitting are rotationally operated to define an apportioning state of the delivery fitting that is configured to manipulate the viscous material toward an inner surface of the outer wall. The apportioning slots in the apportioning state are configured to regulate passage of the viscous material from the dispersion chamber, through the outer wall and into a disk-shaped spread pattern.

8 Claims, 17 Drawing Sheets

MECHANISM FOR DELIVERING HIGHLY VISCOUS MATERIALS FOR COATING AN INTERIOR SURFACE OF A TUBULAR SUBSTRATE

FIELD OF THE INVENTION

The present invention generally relates to material delivery tools, and more specifically, a material delivery tool for applying a highly viscous material onto an interior surface of a tubular substrate, where application is performed in a substantially even coating.

BACKGROUND OF THE INVENTION

In various mechanisms, it is necessary for various operable members to slide with respect to one another, such as adjustable furniture, booms of construction equipment, and other similar mechanical applications. During manufacture, these sliding members require lubrication to promote the sliding operation of the elongated members. Conventional methods of application include linear application nozzles followed by subsequent spreading operations.

SUMMARY OF THE INVENTION

According to one aspect of the present invention, a material delivery assembly includes a delivery fitting attached to a fitting end of a drive shaft. The delivery fitting includes an outer wall that extends perpendicularly from a receiving surface. A plurality of apportioning slots are defined within the outer wall. A dispersion chamber is defined within the outer wall and the receiving surface. A material delivery conduit extends to a delivery port located within the dispersion chamber and is proximate the receiving surface of the delivery fitting. The material delivery port is configured to selectively deliver a viscous material to the receiving surface. The drive shaft and the delivery fitting are selectively and rotationally operated to define an apportioning state of the delivery fitting relative to the delivery port that is configured to manipulate the viscous material toward an inner surface of the outer wall. The plurality of apportioning slots in the apportioning state are configured to regulate passage of the viscous material from the dispersion chamber, through the outer wall and into a disk-shaped spread pattern.

According to another aspect of the present invention, a rotary tool for dispersing a viscous material onto an interior surface of a tubular substrate includes a receiving surface having a plurality of receiving slots defined within the receiving surface. An outer wall extends generally perpendicularly from the receiving surface to define a dispersion chamber. A plurality of apportioning slots are defined within the outer wall. The plurality of receiving slots correspond to the plurality of apportioning slots. The receiving slots are configured to at least partially guide the viscous material into and through the apportioning slots during an apportioning state of the receiving surface.

According to another aspect of the present invention, a method for delivering a substantially even layer of a highly viscous material to an interior surface of a tubular substrate includes delivering the highly viscous material to a rotary tool having an outer wall. The rotary tool is rotated to define a centrifugal biasing force. The highly viscous material is apportioned through a dispersion chamber and along an inner surface of the outer wall of the rotary tool using the centrifugal biasing force. The highly viscous material is projected out from the dispersion chamber via apportioning slots of the outer wall using the centrifugal biasing force. The highly viscous material is projected radially through the apportioning slots in a disk-shaped spread pattern.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
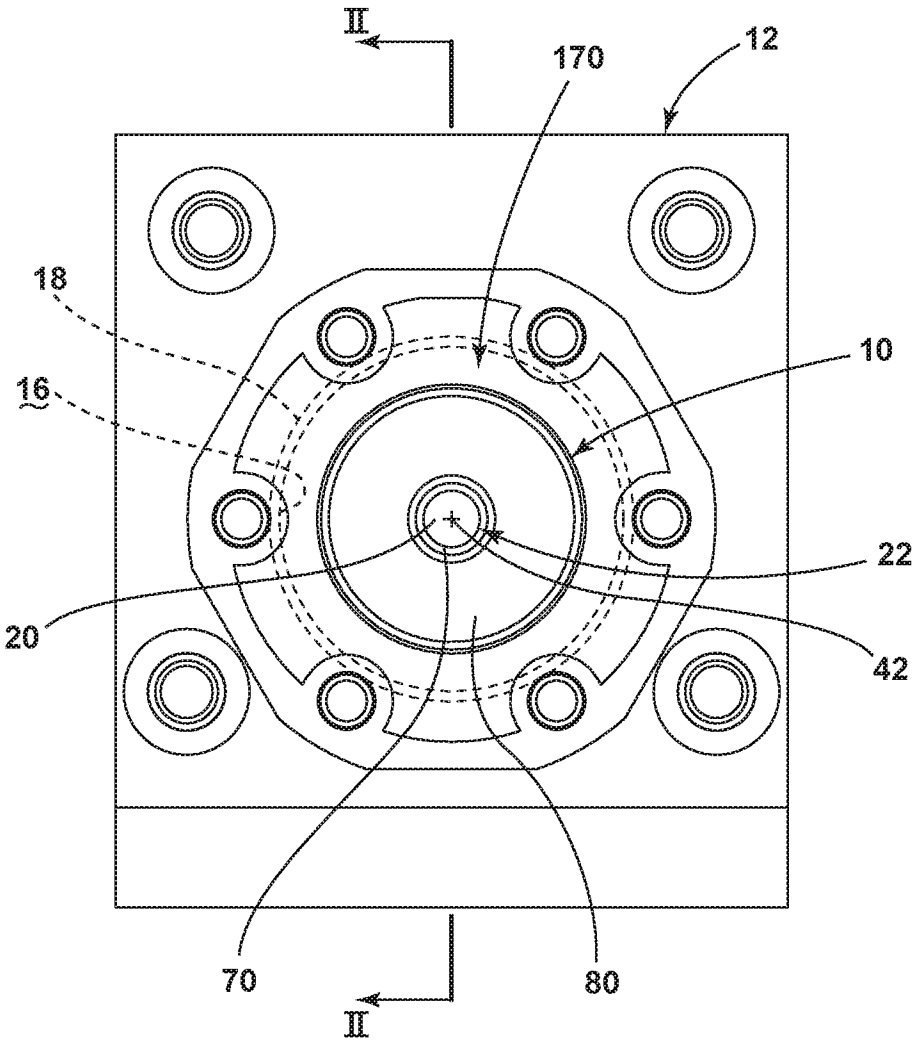
FIG. 1 is an end elevational view of a material delivery assembly incorporating an aspect of a delivery fitting for evenly projecting the highly viscous material in a disk-shaped pattern.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As exemplified in FIGS. 1-3, 20 and 21, reference numeral 10 generally refers to a delivery fitting that is incorporated within the material delivery assembly 12. The material delivery assembly 12 is used for applying viscous material 14, typically a highly viscous material 14, onto an interior surface 16 of a tubular substrate 18. The material delivery assembly 12 is configured to project the viscous material 14 in a substantially even coating 60 along the interior surface 16 of the tubular substrate 18. According to various aspects of the device, the material delivery assembly 12 includes the delivery fitting 10 that is attached to a fitting end 20 of the drive shaft 22. The delivery fitting 10 includes an outer wall 24 that extends perpendicularly from a receiving surface 26. A plurality of apportioning slots 28 are defined within the outer wall 24. A dispersion chamber 30 is defined by an inner surface 32 of the outer wall 24 and the receiving surface 26 and is generally contained within the interior area of the delivery fitting 10. A material delivery conduit 34 is included within the material delivery assembly 12 that extends to a delivery port 36 within the dispersion chamber 30. The delivery port 36 is located proximate the receiving surface 26 of the delivery fitting 10. The material delivery port 36 is configured to selectively deliver a viscous material 14 to the receiving surface 26. The material delivery port 36 of the material delivery conduit 34 can be positioned parallel or substantially parallel with the receiving surface 26. The material delivery conduit 34 can also include an interior sleeve 37 that can be used to narrow the aperture of the material delivery port 36.

Referring again to FIGS. 1-3, 20 and 21, the drive shaft 22 of the material delivery assembly 12 and the delivery fitting 10 selectively and rotationally operate to define an apportioning state 40 of the delivery fitting 10. The apportioning state 40 of the delivery fitting 10 is characterized by the delivery fitting 10 rotating along a rotational axis 42 with the drive shaft 22 relative to the delivery port 36. In this manner, the delivery port 36 remains substantially stationary as the drive shaft 22 and the delivery fitting 10 rotate with respect to the delivery port 36. Rotation of the delivery fitting 10 is configured to manipulate the viscous material 14 toward the inner surface 32 of the outer wall 24 for the delivery fitting 10. The plurality of apportioning slots 28 for the delivery fitting 10, in the apportioning state 40, are configured to regulate passage of the viscous material 14 from the dispersion chamber 30, through the outer wall 24 and into a disk-shaped spread pattern 44. Through this configuration of the material delivery assembly 12, the viscous material 14 can be apportioned throughout the dispersion chamber 30 such that a regulated flow 46 of the viscous material 14 can travel through the apportioning slots 28 and be projected outward from the delivery fitting 10 through the application of centrifugal force 48, otherwise referred to as inertia.

Referring to FIGS. 1-10, 20 and 21, the delivery fitting 10 rotates through operation of the drive shaft 22, which can be operated by any one of various drive assemblies. These drive assemblies can include, but are not limited to, an air-powered mechanism, electrical motors, stepper motors, servo motors, magnetically-driven motors, and other similar motors. Through the use of the drive mechanism, the drive shaft 22 and the delivery fitting 10 can be rotated at a high rate of speed. The rotational speed of the delivery fitting 10 can be within a range of from approximately 100 rpm to approximately 30,000 rpms. The speed at which the delivery fitting 10 is rotated can depend upon the viscosity of the viscous material 14 being delivered through the delivery port 36. A viscous material 14 having a higher viscosity may require a faster rotation of the delivery fitting 10 to produce the substantially even coating 60 of the viscous material 14 that is projected through the apportioning slots 28 of the outer wall 24 for the delivery fitting 10.

Figure 2:
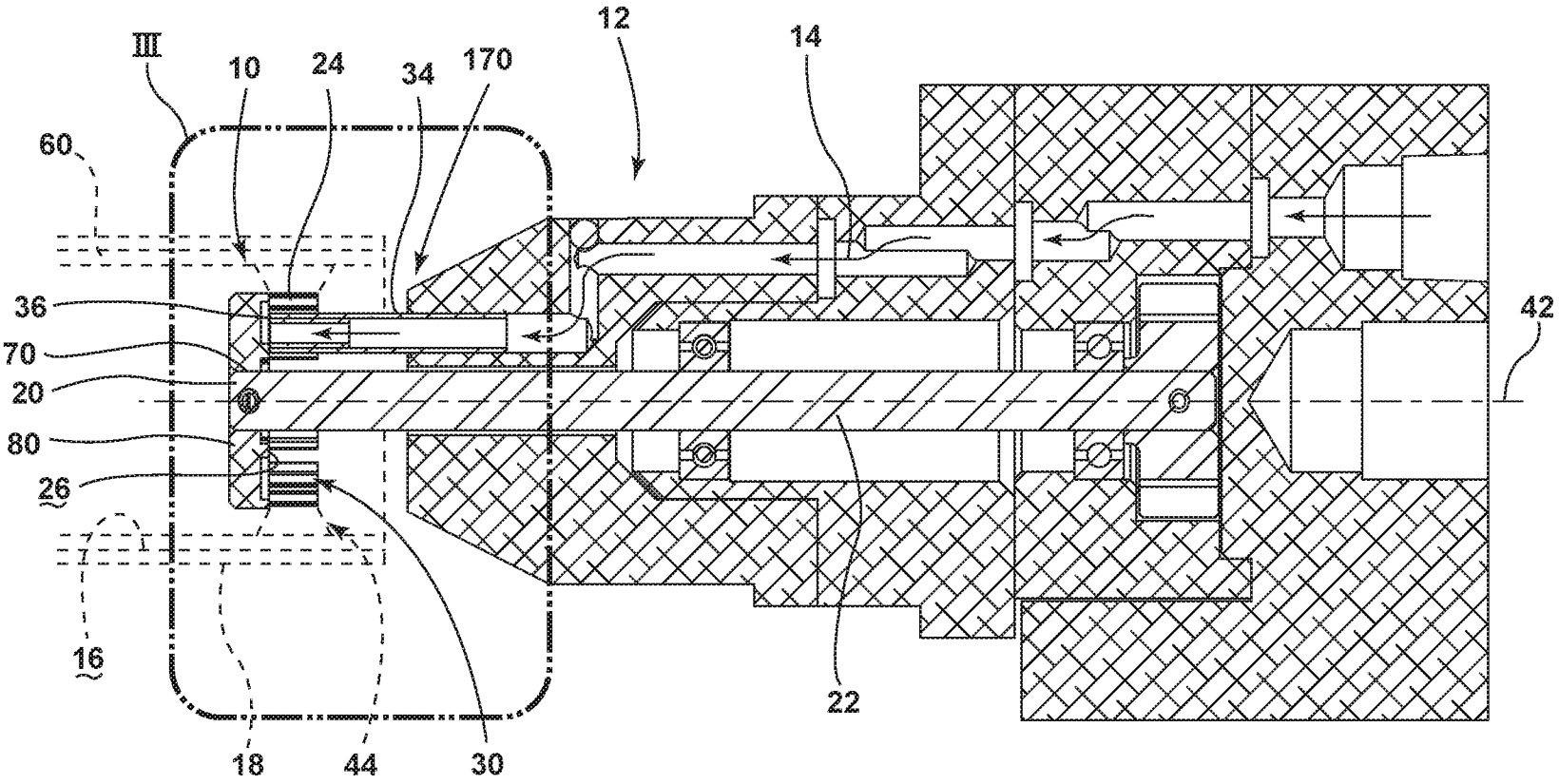
FIG. 2 is a cross-sectional view of the material delivery assembly of FIG. 1 taken along II-II.
Figure 3:
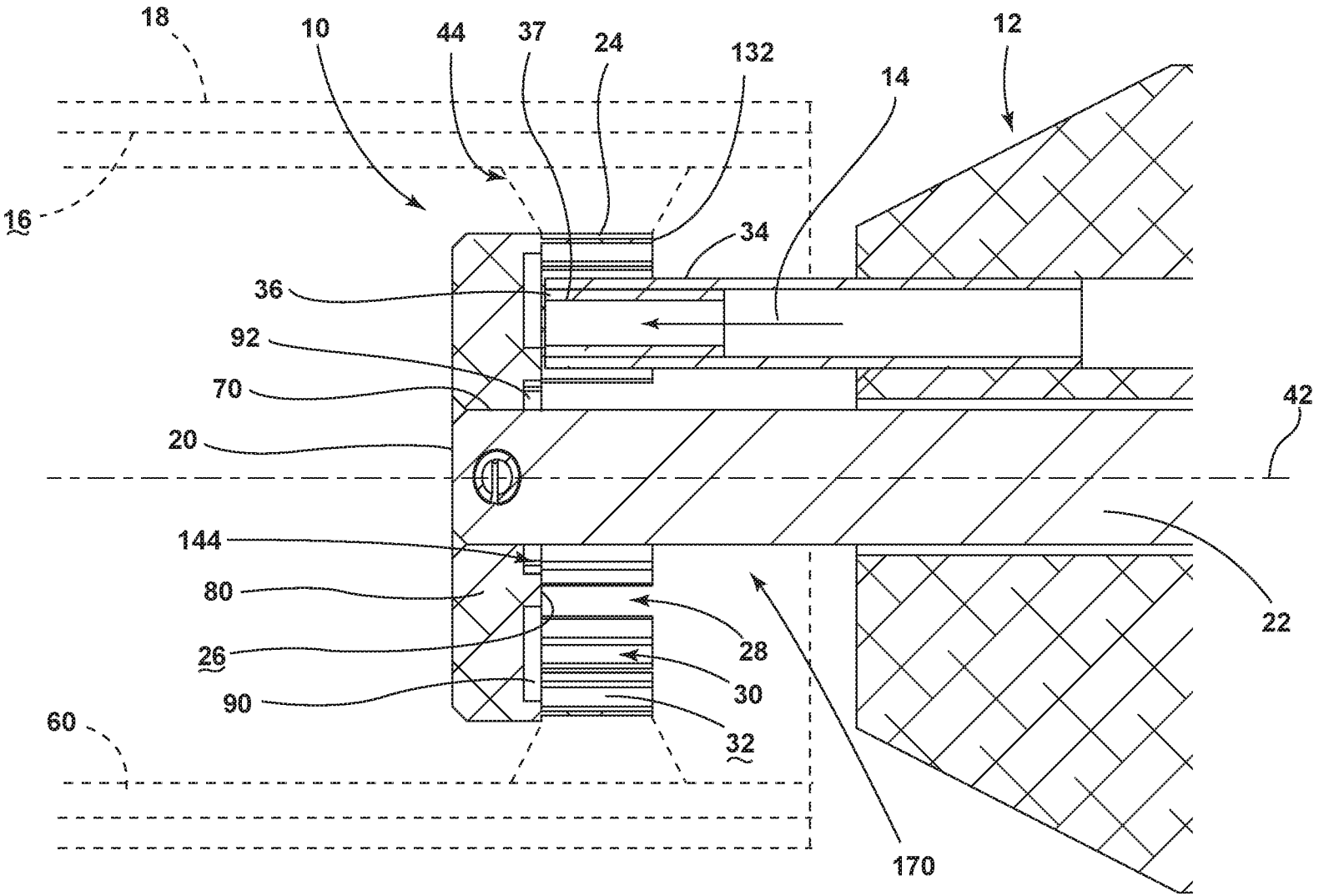
FIG. 3 is an enlarged cross-sectional view of the material delivery assembly of FIG. 2 taken at area III.
Figure 5:
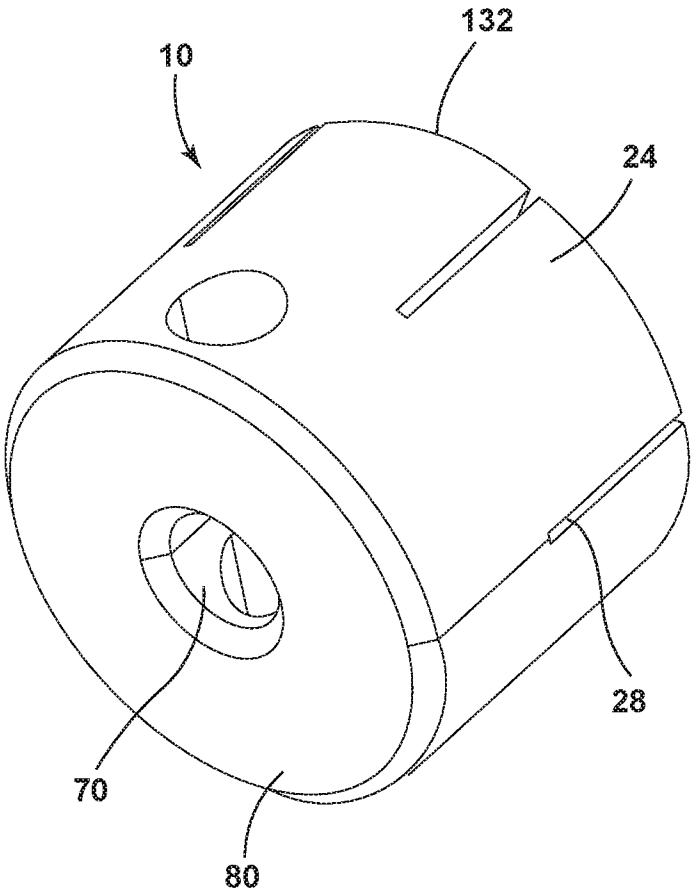
FIG. 5 is a second perspective view of the delivery fitting of FIG. 4.
Figure 4:
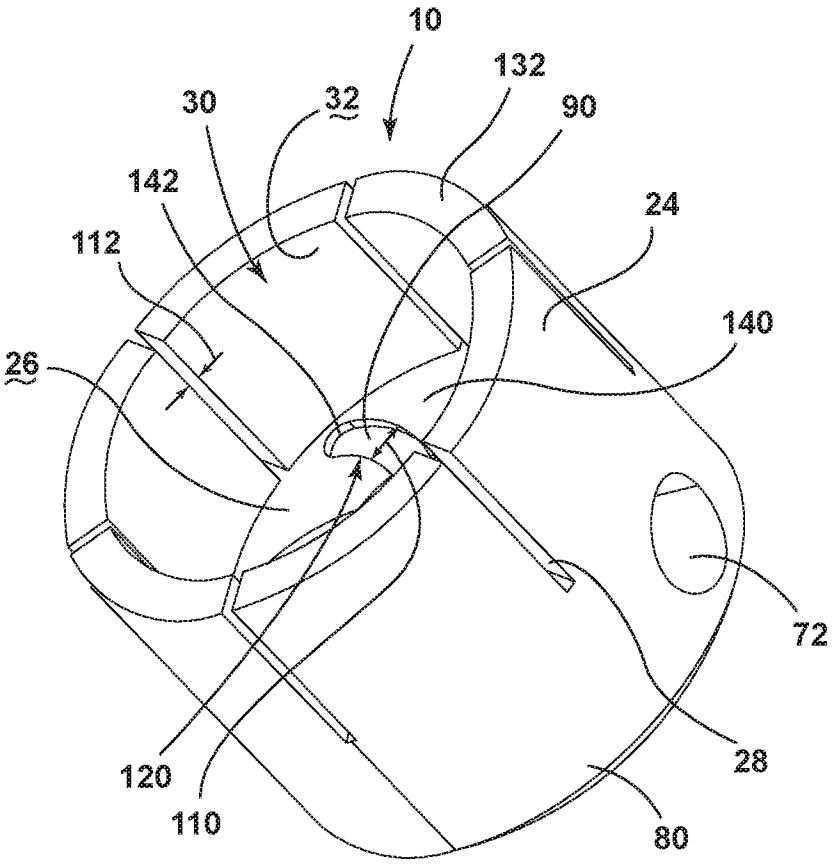
FIG. 4 is a first perspective view of an aspect of the delivery fitting for use in spreading a highly viscous material.
Figure 7:
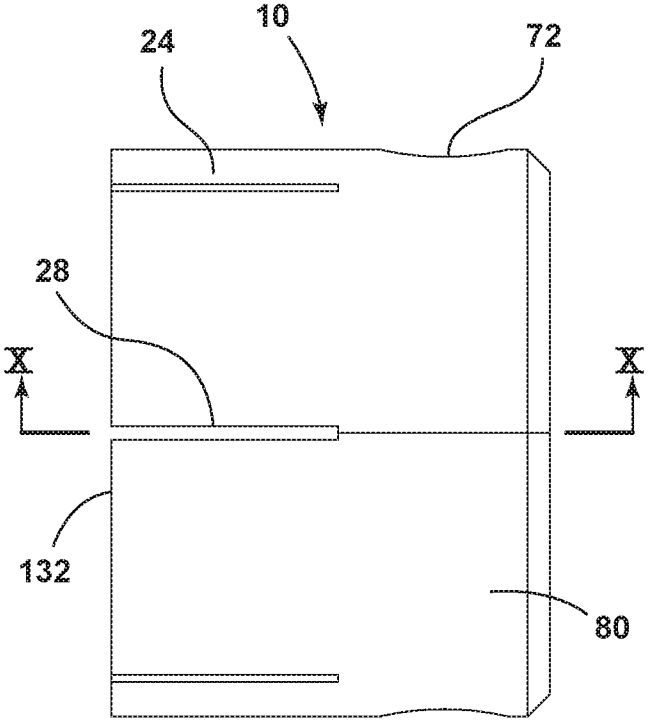
FIG. 7 is a second side elevational view of the delivery fitting of FIG. 4.
Figure 6:
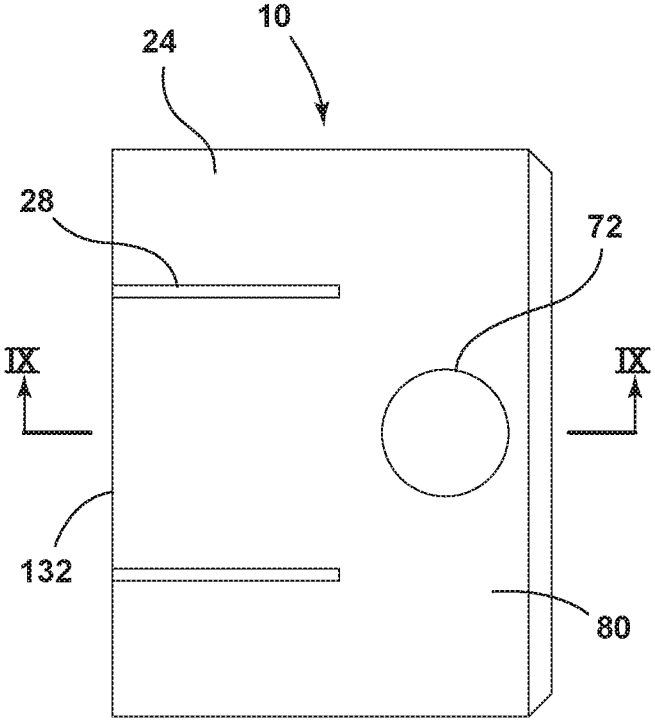
FIG. 6 is a first side elevational view of the delivery fitting of FIG. 4.
Figure 8:
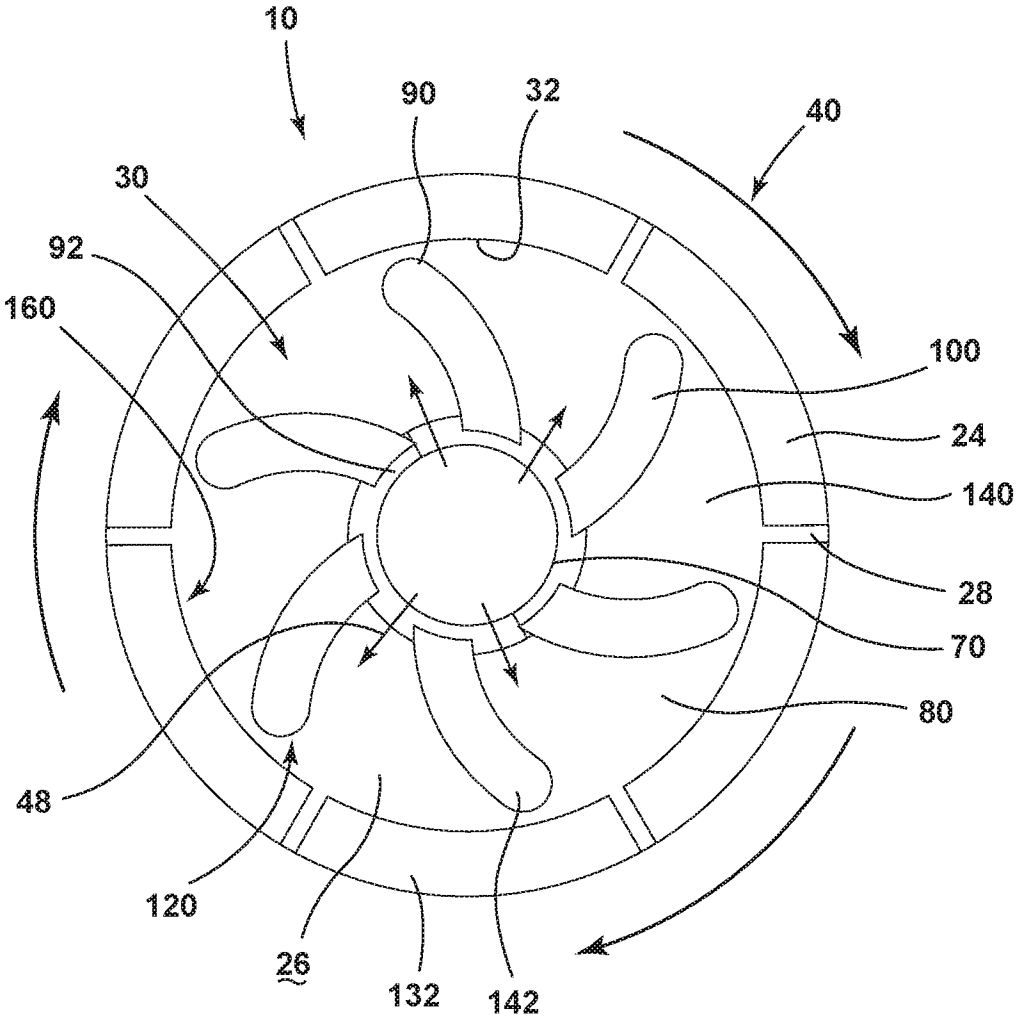
FIG. 8 is a schematic plan view of the delivery fitting of FIG. 4, showing the delivery fitting in an apportioning state.
Figure 10:
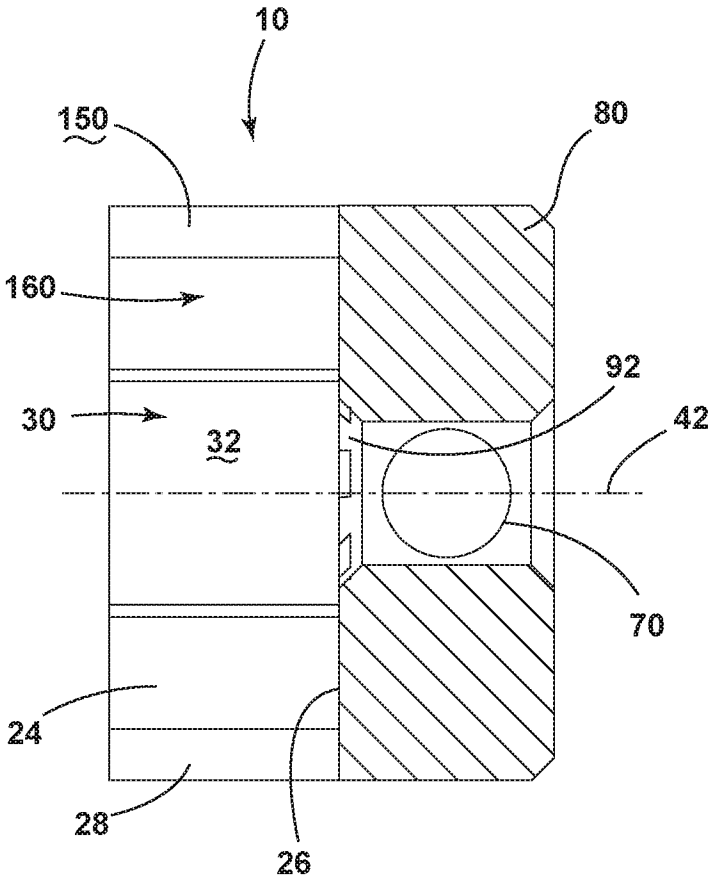
FIG. 10 is a cross-sectional view of the delivery fitting of FIG. 7, taken along line X-X; at area III.
Figure 9:
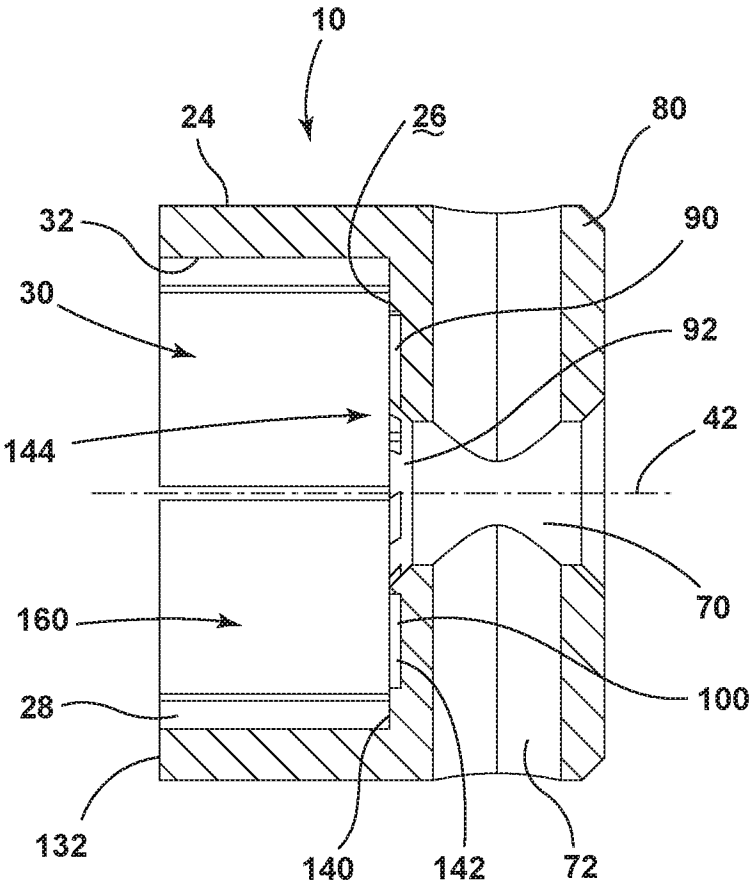
FIG. 9 is a cross-sectional view of the delivery fitting of FIG. 6, taken along line IX-IX.
Figure 12:
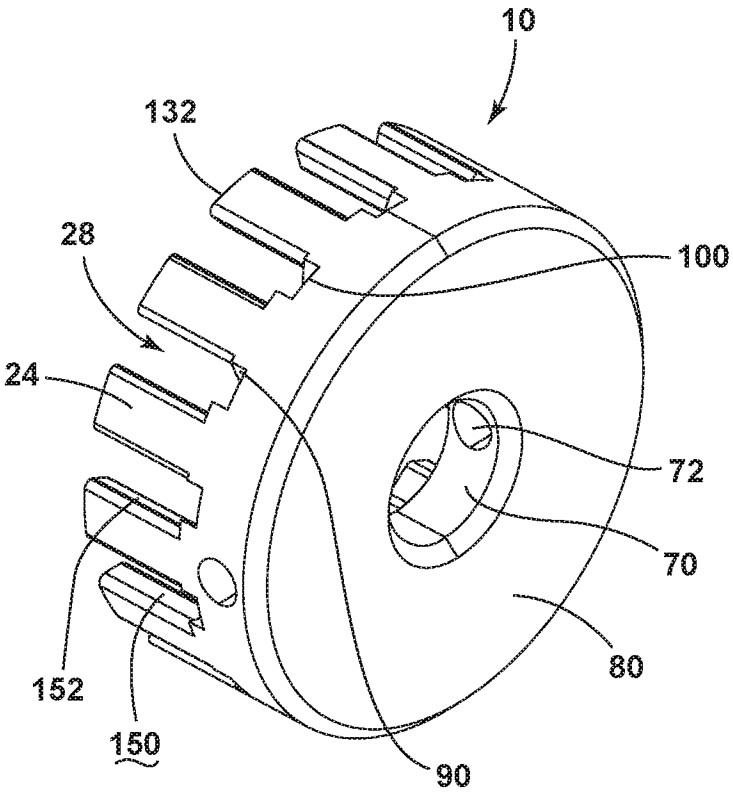
FIG. 12 is a second perspective view of the delivery fitting of FIG. 11.
Figure 11:
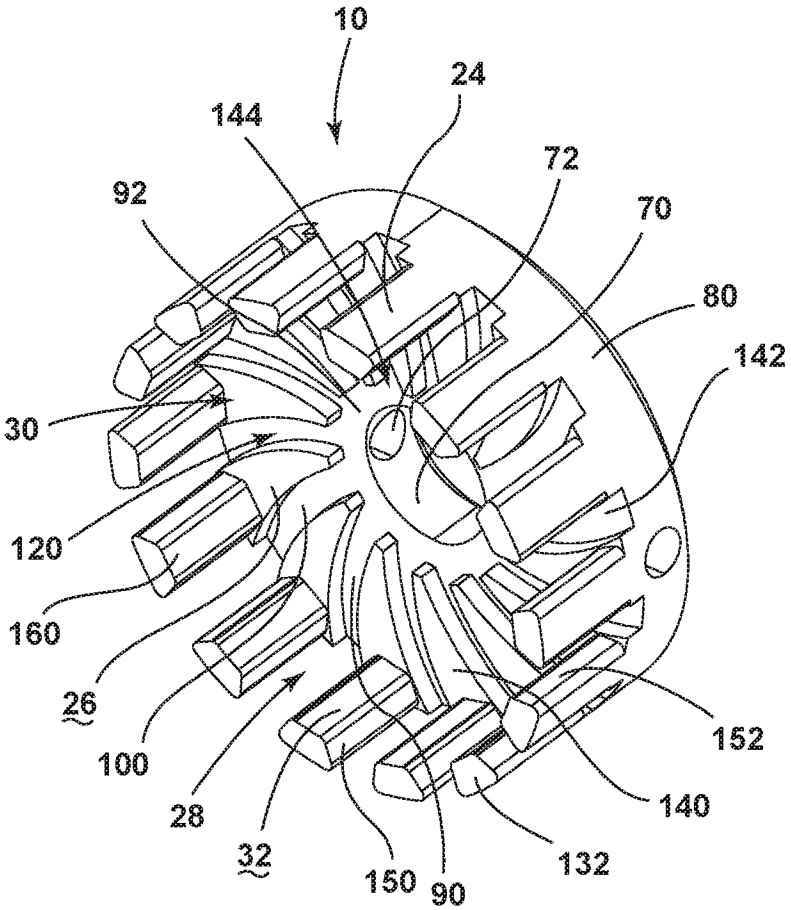
FIG. 11 is a first perspective view of an aspect of the delivery fitting for use in spreading a highly viscous material.
Figure 14:
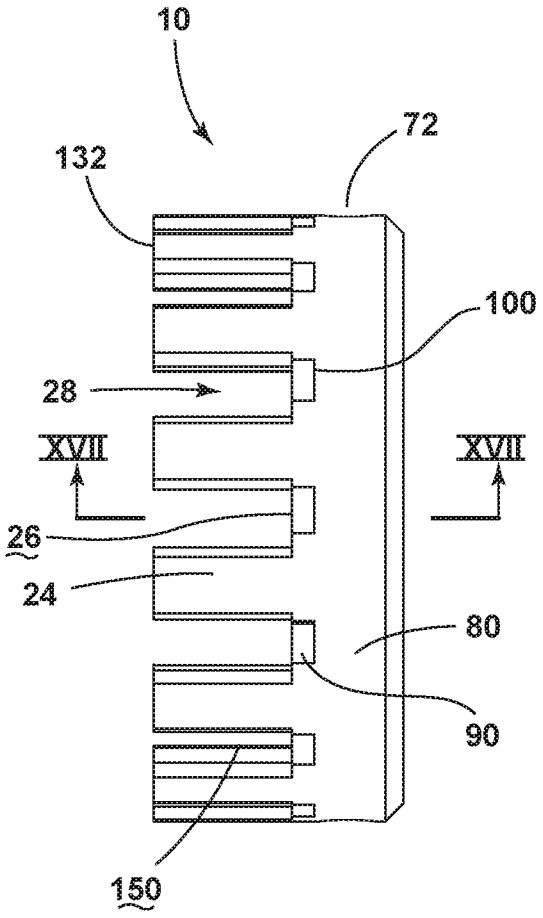
FIG. 14 is a second side elevational view of the delivery fitting of FIG. 11.
Figure 13:
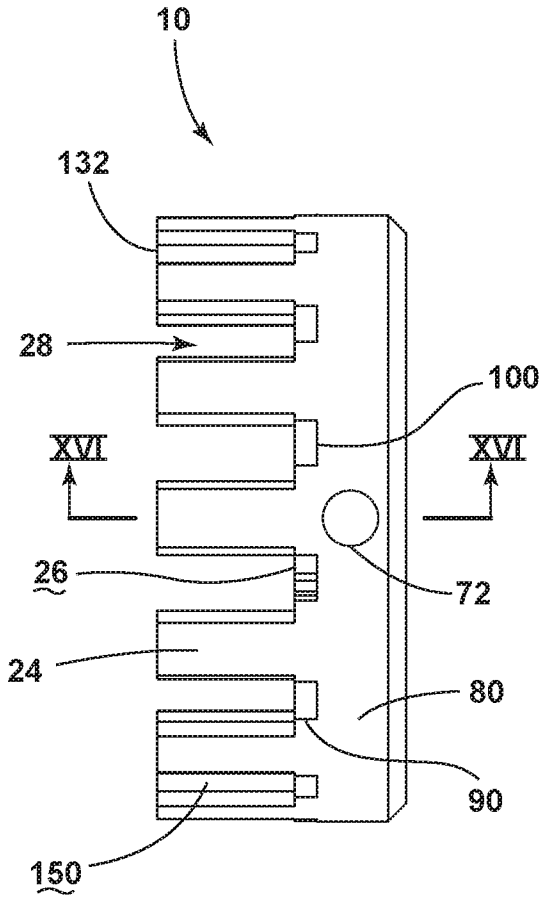
FIG. 13 is a first side elevational view of the delivery fitting of FIG. 11.
Figure 15:
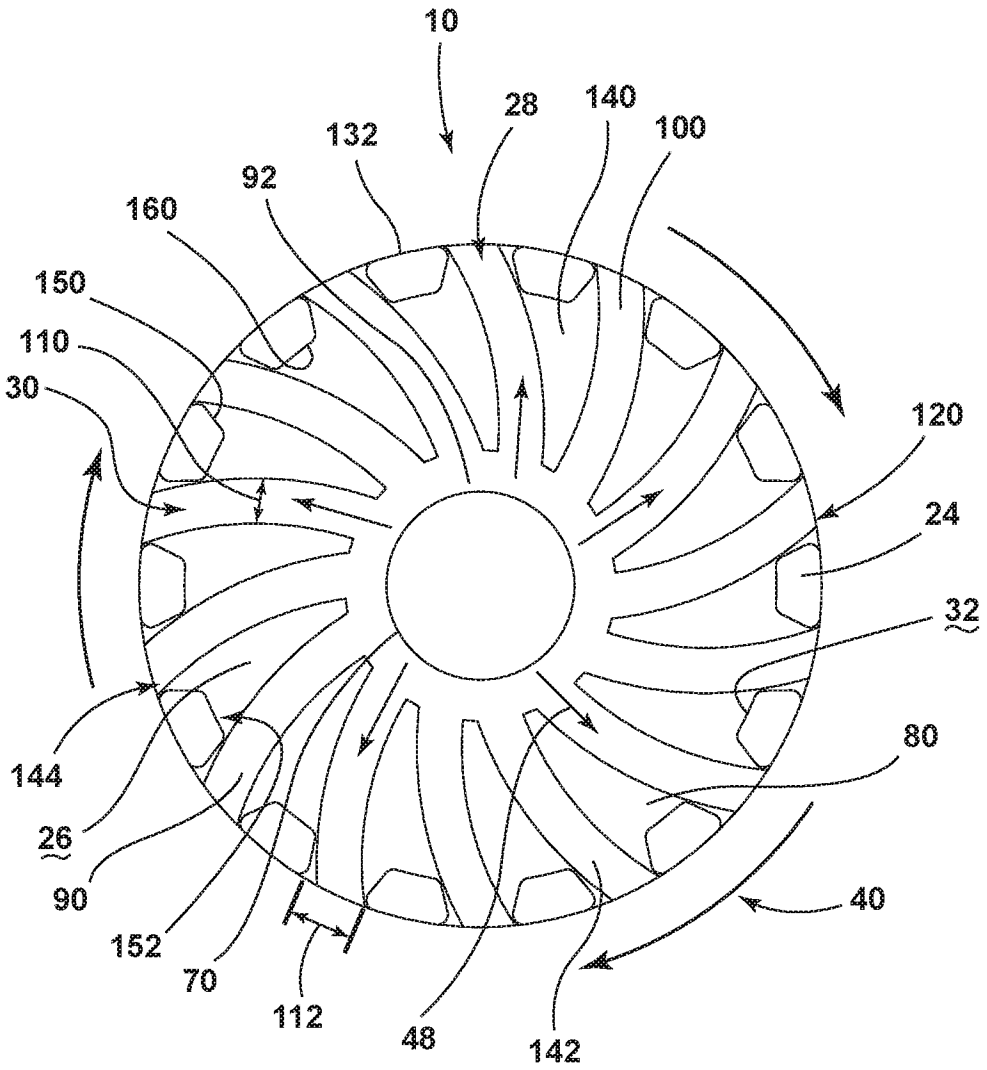
FIG. 15 is a schematic plan view of the delivery fitting of FIG. 11, showing the delivery fitting in an apportioning state.
Figure 17:
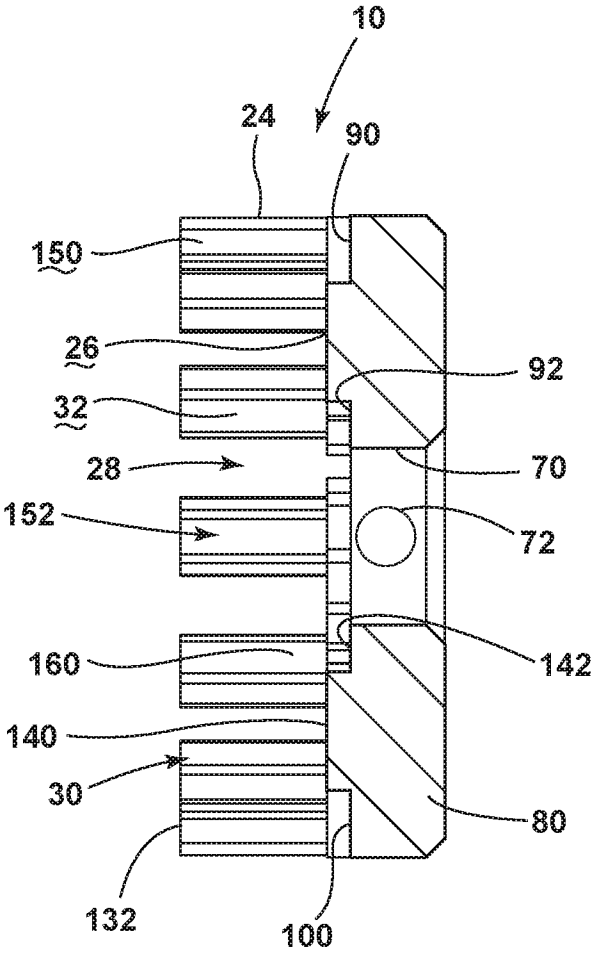
FIG. 17 is a cross-sectional view of the delivery fitting of FIG. 14, taken along line XVII-XVII.
Figure 16:
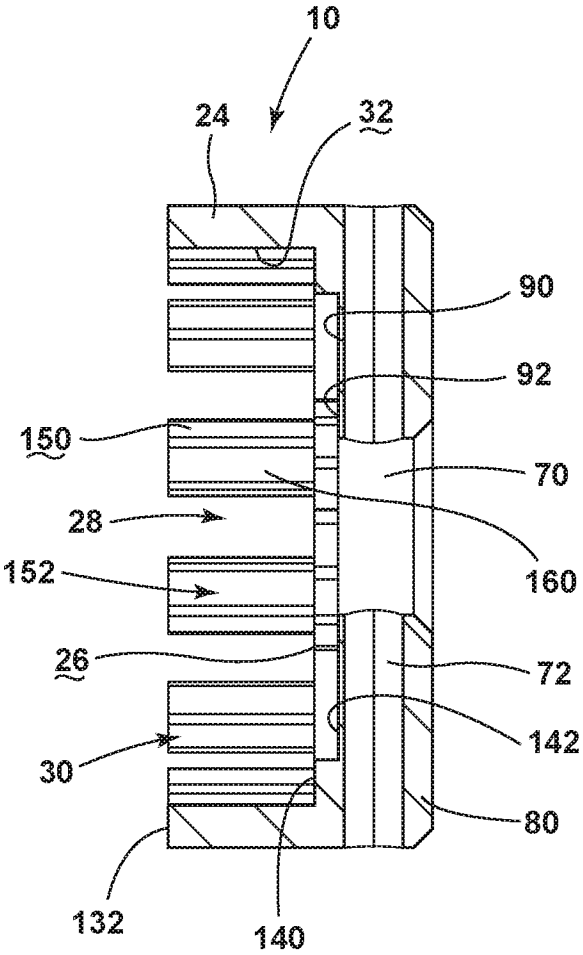
FIG. 16 is a cross-sectional view of the delivery fitting of FIG. 13, taken along line XVI-XVI.
Figure 19:
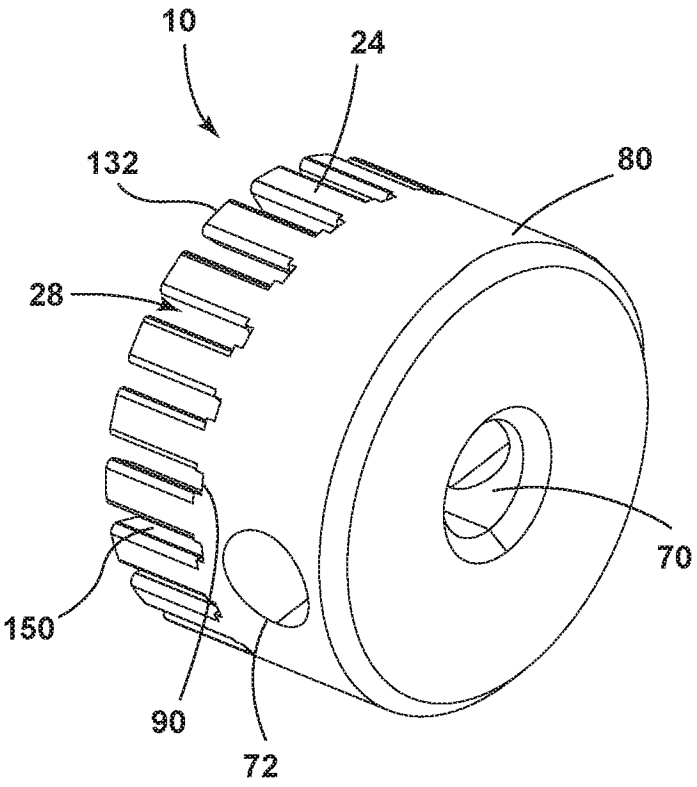
FIG. 19 is a second perspective view of the delivery fitting of FIG. 18.
Figure 18:
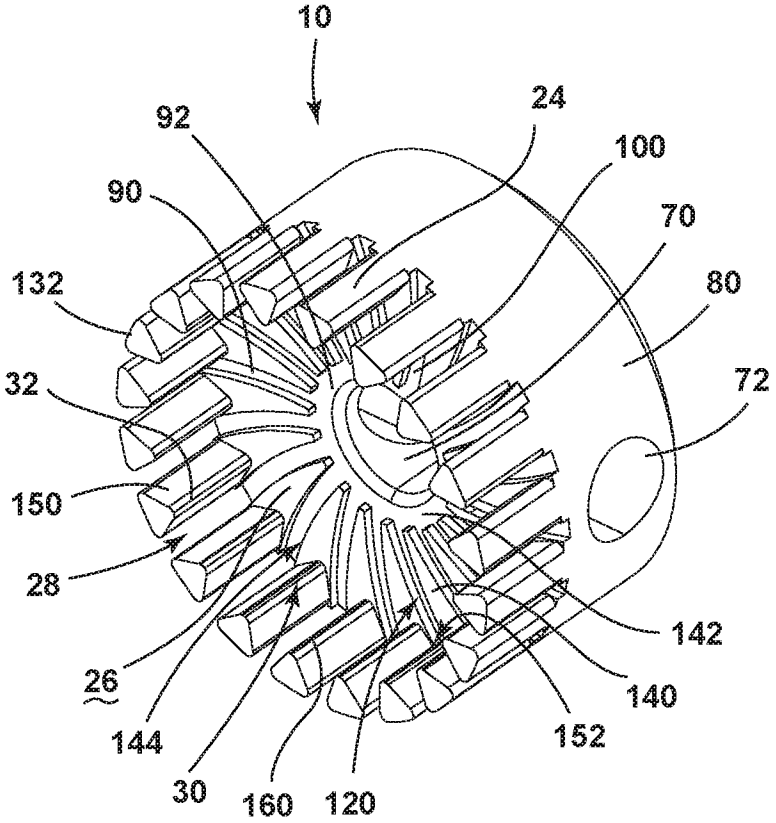
FIG. 18 is a first perspective view of an aspect of a delivery fitting for spreading a highly viscous material.

As exemplified in FIGS. 2 and 3, material delivery conduit 34 extends into close proximity with the receiving surface 26 of the delivery fitting 10. In this manner, the delivery port 36 can be located within a distance of a millimeter or less within the receiving surface 26 of the delivery fitting 10. The close contact between the delivery port 36 and the receiving surface 26 allows for small and incremental amounts of the viscous material 14 to be taken, pushed, severed or otherwise removed from the delivery port 36 for manipulation within the dispersion chamber 30 of the delivery fitting 10. As the delivery fitting 10 rotates to define the apportioning state 40, the viscous material 14 is manipulated within the dispersion chamber 30. The rotation of the delivery fitting 10 causes the centrifugal force 48 that biases the viscous material 14 toward the outer wall 24. In this manner, the viscous material 14 tends to accumulate upon portions of the outer wall 24. This accumulation of the viscous material 14 upon the inner surface 32 of the outer wall 24 then travels into and through the various apportioning slots 28. Accordingly, the viscous material 14 is moved in a regulated flow 46 or a substantially regulated flow 46 through the apportioning slots 28. The viscous material 14 is then projected away from the outer wall 24 through the application of the centrifugal force 48 (inertia) in the general shape of a disk-shaped spread pattern 44 that emanates from the outer wall 24 of the delivery fitting 10.

In various aspects of the device, as exemplified in FIGS. 1-3 and 23-24, the material delivery port 36 can include a rim 38 that is oriented at an angle with respect to the receiving surface 26. In such an embodiment, the rim 38 includes a leading edge 50 and a trailing edge 52. The angled configuration of the rim 38 of the delivery port 36 is positioned such that the leading edge 50 is farther from the receiving surface 26 than the trailing edge 52. During rotational operation of the delivery fitting 10, the angled rim 38 defines a clearance space 54 above the receiving surface 26. This clearance space 54 allows for a controlled build up or accumulation of the viscous material 14 that is distributed by the receiving surface 26. During the manipulation of highly viscous materials 14, the viscous material 14 moving through the material delivery conduit 34 may not occur evenly. The uneven delivery of the viscous material 14 is accommodated through the clearance space 54. Accordingly, periodic accumulations of the viscous material 14 can be distributed through the clearance space 54 to be manipulated by the receiving surface 26.

Referring now to FIGS. 4-10, the delivery fitting 10 includes the receiving surface 26 and an outer wall 24 that extends from the receiving surface 26 in a substantially perpendicular formation. The delivery fitting 10 includes a central bore 70 that receives the fitting end 20 of the drive shaft 22. One or more lateral bores 72 are configured to receive fasteners that can engage the fitting end 20 of the drive shaft 22 within the central bore 70. Through this configuration, the delivery fitting 10 is fixedly attached to the fitting end 20 of the drive shaft 22 through rotation at a wide range of rotational speeds.

As exemplified in FIG. 3, the dispersion chamber 30 is defined within the delivery fitting 10 and surrounds the drive shaft 22 and is outwardly bound by the inner surface 32 of the outer wall 24 and the receiving surface 26 of the delivery fitting 10. The receiving surface 26 is defined by the base member 80 that includes the central bore 70 and from which the outer wall 24 perpendicularly extends. As discussed above, the delivery port 36 of the material delivery conduit 34 is positioned within the dispersion chamber 30 and in close contact with the receiving surface 26 of the base member 80.

Referring again to FIGS. 4-10, the receiving surface 26 includes a plurality of receiving slots 90 that radiate outward from a central region 92 of the base member 80 and extend outward toward the outer wall 24 of the delivery fitting 10. The central region 92 of the base member 80 can include the central bore 70 for receiving the fitting end 20 of the drive shaft 22. Through this configuration, the receiving slots 90 of the base member 80 extend outward from the central region 92 and radiate toward the outer wall 24. In various aspects of the device, the number of receiving slots 90 can correspond to the number of apportioning slots 28 that are defined within the outer wall 24. In such a configuration, the receiving slots 90 extend from the central region 92 and extend outward such that each receiving slot 90 corresponds to a respective apportioning slot 28. In various aspects of the device, it is also contemplated that the number of receiving slots 90 can differ from a number of apportioning slots 28. As will be discussed more fully below, the configuration of the receiving slots 90 in relation to the apportioning slots 28 can vary depending on the viscosity of the viscous material 14 being manipulated within the delivery fitting 10.

Referring now to FIGS. 11-17, 20 and 21, where the receiving slots 90 are configured to correspond to respective apportioning slots 28, it is contemplated that the receiving slots 90 can extend to and at least partially through the outer wall 24. In such a configuration, the receiving slots 90 can define a portion of the apportioning slots 28. As exemplified in FIG. 11, each receiving slot 90 extends outward from the central region 92 and extends through the outer wall 24. The receiving slot 90 defines part of the apportioning slot 28. Accordingly, the receiving slot 90 and the apportioning slot 28 define a substantially continuous recessed area 100 that allows for the manipulation of the viscous material 14, as well as the substantially even and regulated flow 46 of the viscous material 14 through the apportioning slots 28 of the outer wall 24. Such a configuration is typically utilized where the material is a viscous material 14 having a high viscosity that may be difficult to apply onto a substrate through conventional means. Using the delivery fitting 10, the highly viscous material 14 can be manipulated within the dispersion chamber 30 as the delivery fitting 10 rotates at a substantially high rate of speed. The cooperation of the receiving slots 90 and the apportioning slots 28 serves to manipulate the highly viscous material 14 away from the delivery port 36 and toward the inner surface 32 of the outer wall 24. During rotation of the delivery fitting 10, and as discussed above, the highly viscous material 14 can be regulated as a substantially even and regulated flow 46 that can be projected outward as the disk-shaped spread pattern 44 for application onto the interior surface 16 of the tubular substrate 18.

Referring again to FIGS. 4-10, in various aspects of the device, the delivery fitting 10 may include apportioning slots 28 that have a minimal width. This minimal width may be as little as approximately 10 microns. Where the apportioning slots 28 have this minimal width, the surface area of the inner surface 32 of the outer wall 24 is configured to receive greater amounts of the viscous material 14. As this viscous material 14 is accumulated on the inner surface 32 of the outer wall 24, the apportioning slots 28 serve to regulate the flow of the viscous material 14 therethrough for apportioning the viscous material 14 in the disk-shaped spread pattern 44 for application onto the interior surface 16 of the tubular substrate 18. It should be understood that greater or lesser widths of the apportioning slots 28 may be contemplated depending upon the viscosity and workability of the viscous material 14 being applied to the interior surface 16 of the tubular substrate 18.

Referring again to FIGS. 11-17, in various aspects of the device, the receiving slots 90 and the apportioning slots 28 may have widths that can vary depending upon the exact configuration of the delivery fitting 10. In various aspects of the device, the receiving slots 90 may have a first width 110 and the apportioning slots 28 may have a second width 112 that is different than the first width 110. It is also contemplated that the first width 110 and second width 112 may be equal, such that the second width 112 of the apportioning slots 28 at the outer wall 24 may be substantially equal to the first width 110 of the receiving slots 90 of the outer wall 24.

As exemplified in FIGS. 4-17, the receiving slots 90 may extend outward from the central region 92 in various patterns. Typically, the receiving slots 90 extend outward from the central region 92 in a spiral-type configuration 120. In this spiral-type configuration 120, the receiving slots 90 may have a consistent first width 110 that extends from the central region 92 and toward or at least partially through the outer wall 24. It is also contemplated that the receiving slots 90 may have a varying first width 110. In such an embodiment, the receiving slots 90 near the central region 92 may have a narrower width in this central region 92 and may flare outward toward the outer wall 24 where each receiving slot 90 may have a greater width. Typically, the receiving slots 90 will have a consistent first width 110 along the entire length from the central region 92 and to the outer wall 24.

As exemplified in FIGS. 4-17, 20 and 21, the spiral-type orientation of the receiving slots 90 within the receiving surface 26 are configured to promote the manipulation of the viscous material 14 within the dispersion chamber 30. The spiral-type configuration 120 promotes the centrifugal force 48 and resulting outward movement 130 of the viscous material 14 away from the rotational axis 42 and toward the inner surface 32 of the outer wall 24. The receiving slots 90 having the spiral-type configuration 120 tend to push the viscous material 14 in a generally outward movement 130 to engage the inner surface 32 of the outer wall 24. Additionally, the rotation of the delivery fitting 10 utilizes the centrifugal force 48 or inertia to cause the viscous material 14 to flow in an accumulating movement 134 away from the receiving surface 26 and onto a substantial portion of the inner surface 32 of the outer wall 24. In this manner, the viscous material 14 is moved away from the receiving surface 26 and toward an outer edge 132 of the delivery fitting 10. Through this movement of the viscous material 14, the viscous material 14 is directed to travel along the inner surface 32 and through a substantial portion of each apportioning slot 28 to form the disk-shaped spread pattern 44.

Referring again to FIGS. 4-17, within the various configurations of the delivery fitting 10, the receiving surface 26 can include a primary receiving area 140 and a secondary receiving area 142. The secondary receiving area 142 is typically the recessed area 100 within the primary receiving area 140 to define receiving slots 90 of the base member 80 that define a receiving surface 26. It is contemplated that this secondary receiving area 142 can be a continuous area that is defined within the central region 92 of the receiving surface 26 and radiates outward to the outer wall 24. It is also contemplated that where the receiving slots 90 do not intersect with one another or flow into one another, the secondary receiving area 142 can be in the form of multiple disjointed components of the secondary receiving area 142. Through the configuration of the primary and secondary receiving areas 140, 142, the receiving surface 26 defines a textured configuration 144 that serves to agitate or otherwise manipulate the viscous material 14 as it is delivered through the delivery port 36 of the material delivery conduit 34. This textured configuration 144 of the receiving surface 26 is typically in the form of the spiral-type configuration 120 of the receiving slots 90 that promote the centrifugal force 48 or outward biasing force that urges the viscous material 14 in the outward direction toward the inner surface 32 of the outer wall 24.

Referring now to FIGS. 11-21, in various aspects of the device, the number of apportioning slots 28 can be modified depending upon the viscosity of the viscous material 14 being manipulated by the delivery fitting 10. In certain aspects of the delivery fitting 10, the apportioning slots 28 can include a generally tapered cross section that can be in the general form of a triangle or trapezoid. In this configuration, the apportioning slots 28 can define, therebetween, a plurality of apportioning surfaces 150. These apportioning surfaces 150 can be angled to promote the even and regulated flow 46 of the viscous material 14 through each apportioning slot 28. Stated another way, the angled apportioning surfaces 150 of the outer wall 24 can define a plurality of undulating portions 152 of the inner surface 32 of the outer wall 24. The undulating portions 152 and the apportioning surfaces 150 serve to separate portions of the viscous material 14 to flow into adjacent apportioning slots 28 during rotation of the delivery fitting 10 in the apportioning state 40. In certain aspects of the device, the viscous material 14 can be a highly viscous material 14 that tends to clump and may be difficult to evenly apportion onto a surface of a substrate. By rotating the delivery fitting 10 at the high rate of speed, these highly viscous materials 14 can be manipulated within the dispersion chamber 30 and directed outward and through the apportioning slots 28 in a regulated flow 46 or substantially regulated flow 46. Additionally, through the configuration of the outer wall 24 and the inner surface 32 of the outer wall 24, the apportioning slots 28 can provide the undulating portions 152 and angled apportioning surfaces 150 along which the highly viscous material 14 can slidably move toward the outside surface of the delivery fitting 10. Through the rotation of the delivery fitting 10, these highly viscous materials 14 can be released in a substantially even and regulated flow 46 to promote the disk-shaped spread pattern 44 to deposit the highly viscous material 14 onto the inner surface 32 of the tubular substrate 18.

Figure 20:
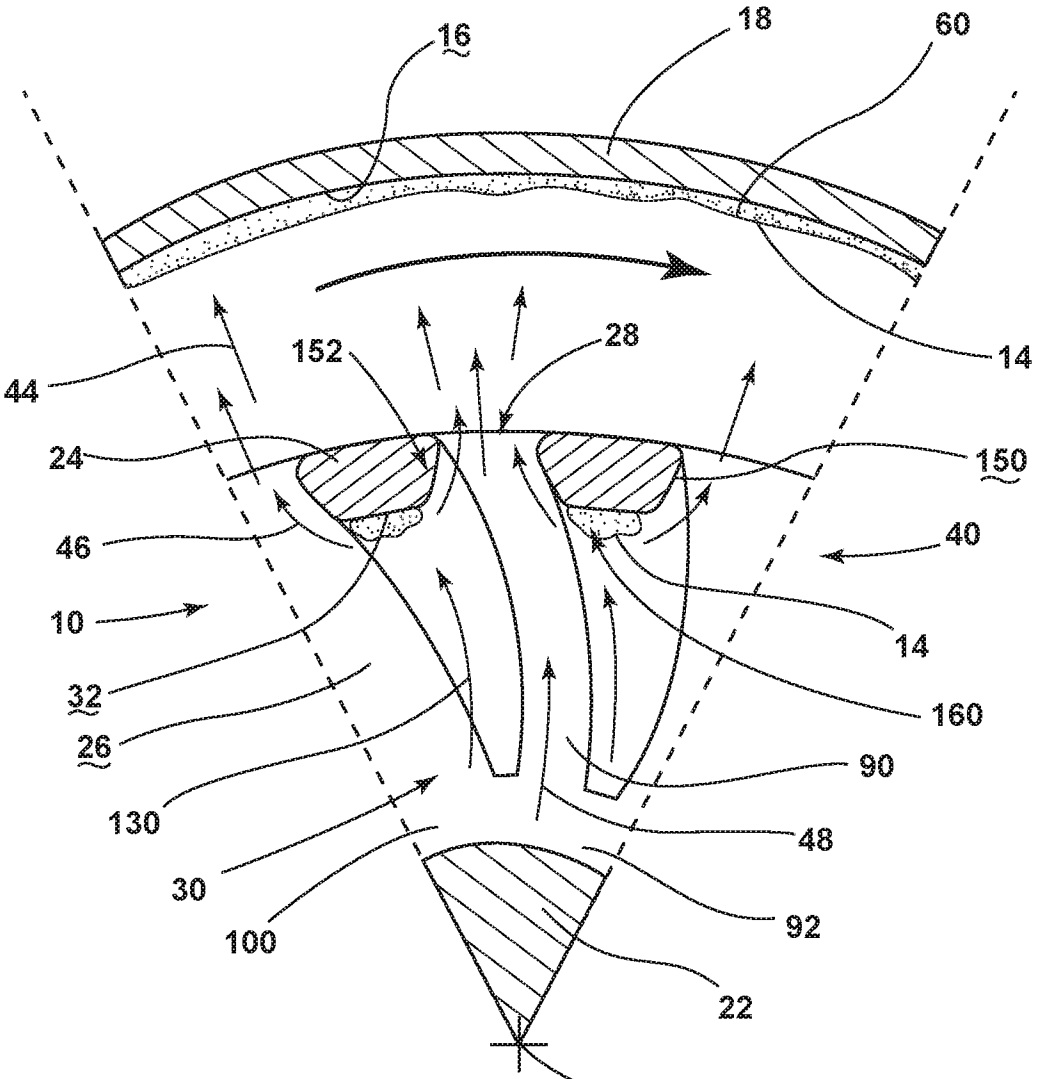
FIG. 20 is a schematic plan view of a section of a delivery fitting illustrating movement of a highly viscous material through the delivery fitting.
Figure 21:
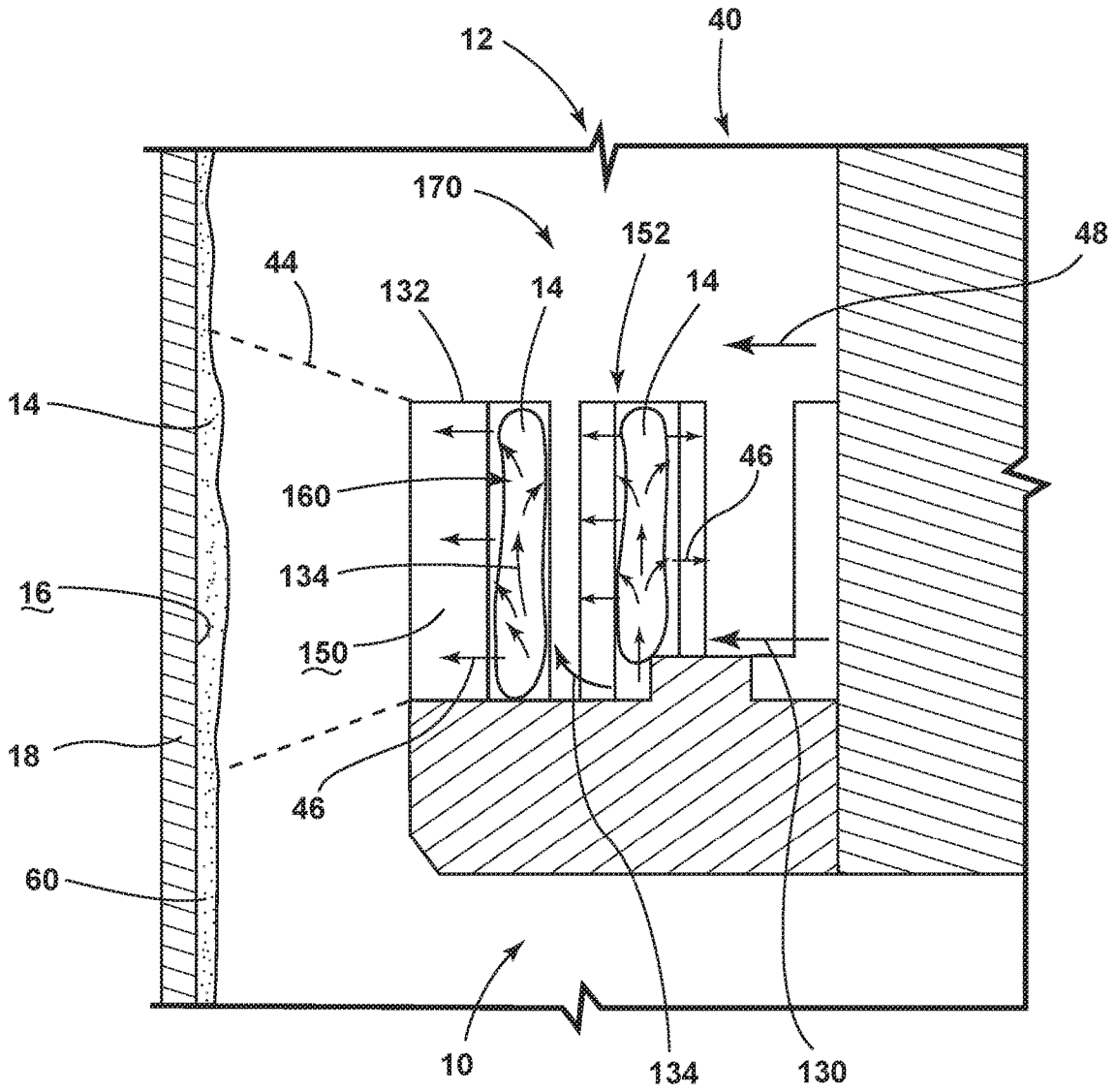
FIG. 21 is a partial schematic cross-sectional view of the delivery fitting of FIG. 20 showing projection of the highly viscous material from the delivery fitting.
Figure 22:
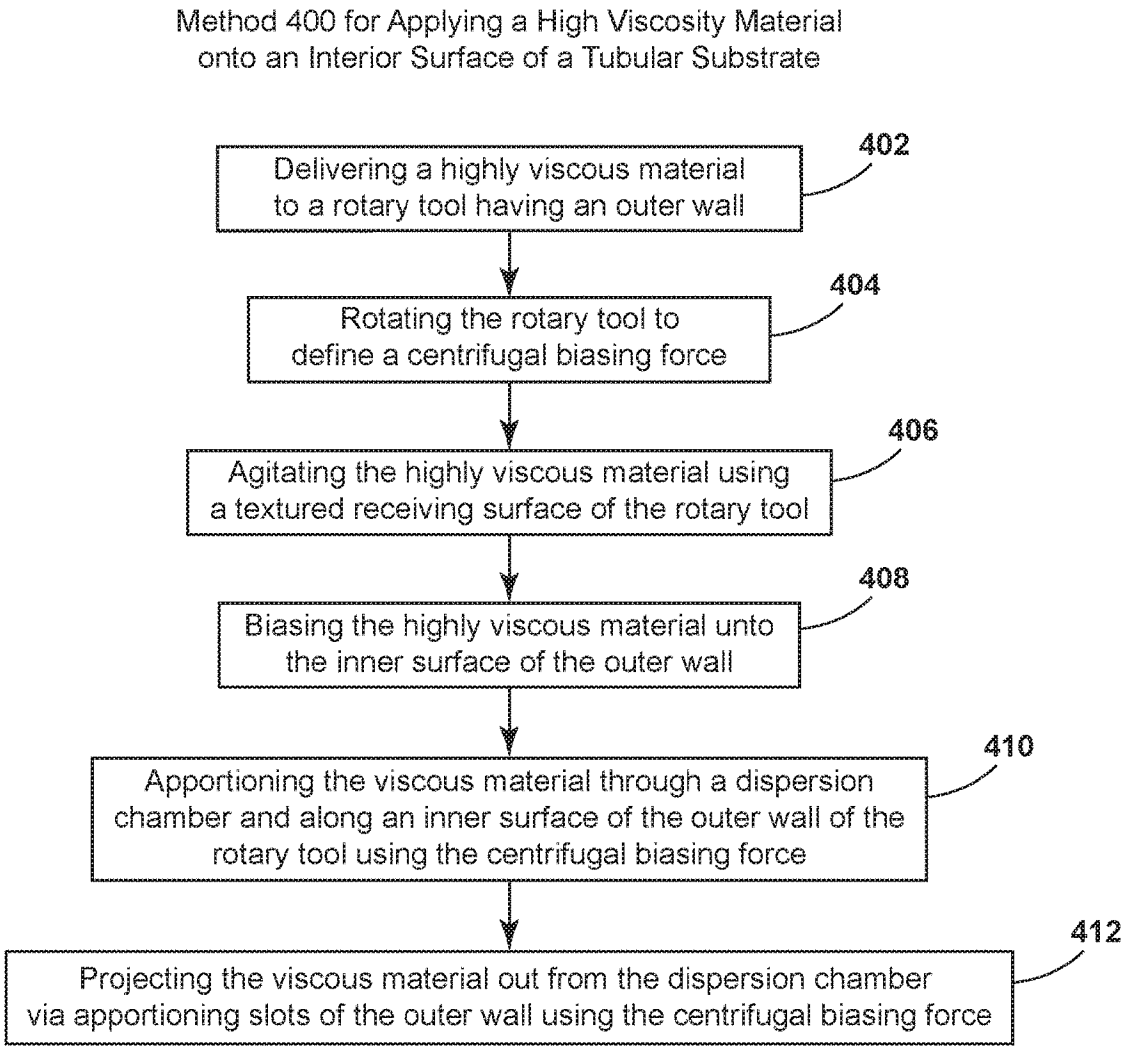
FIG. 22 is linear flow diagram illustrating a method for delivering a substantially even layer of a highly viscous material to an interior surface of a tubular substrate.
Figure 23:
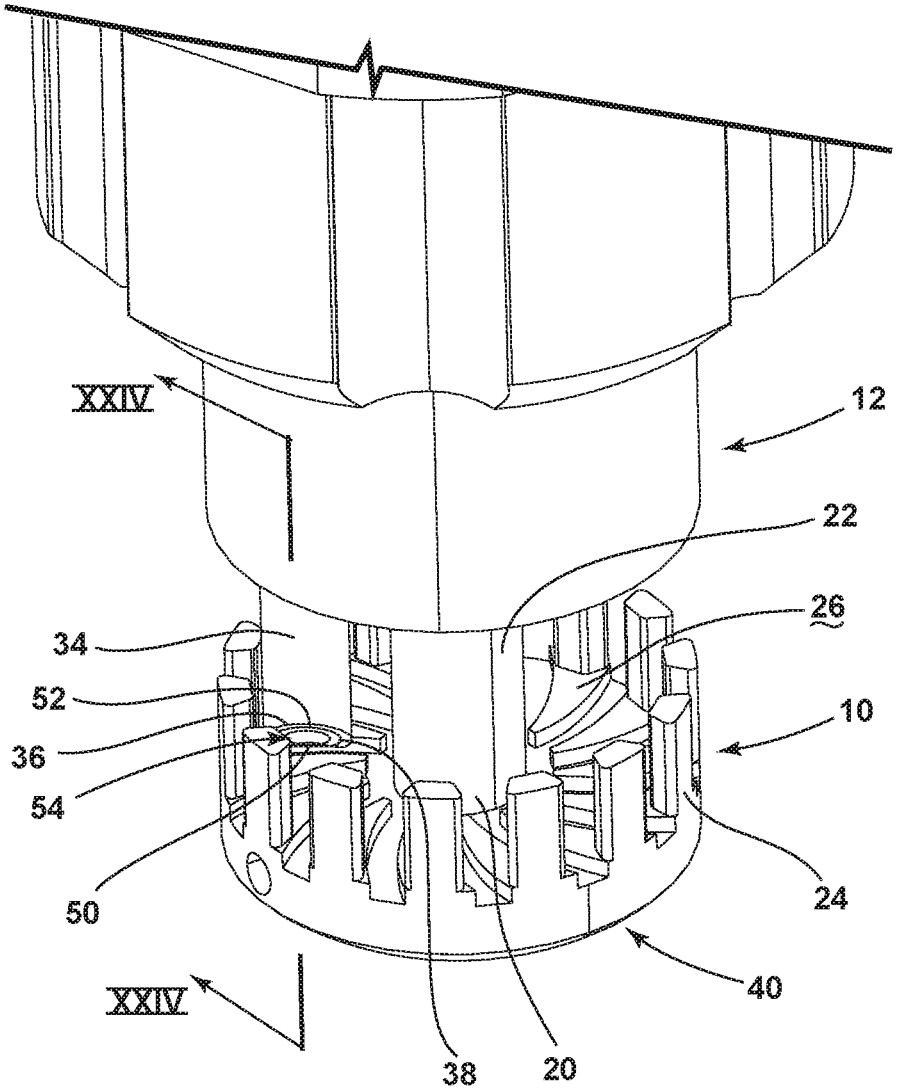
FIG. 23 is a perspective view of the dispersion chamber of an aspect of the delivery fitting and illustrating an angled rim of the material delivery port.
Figure 24:
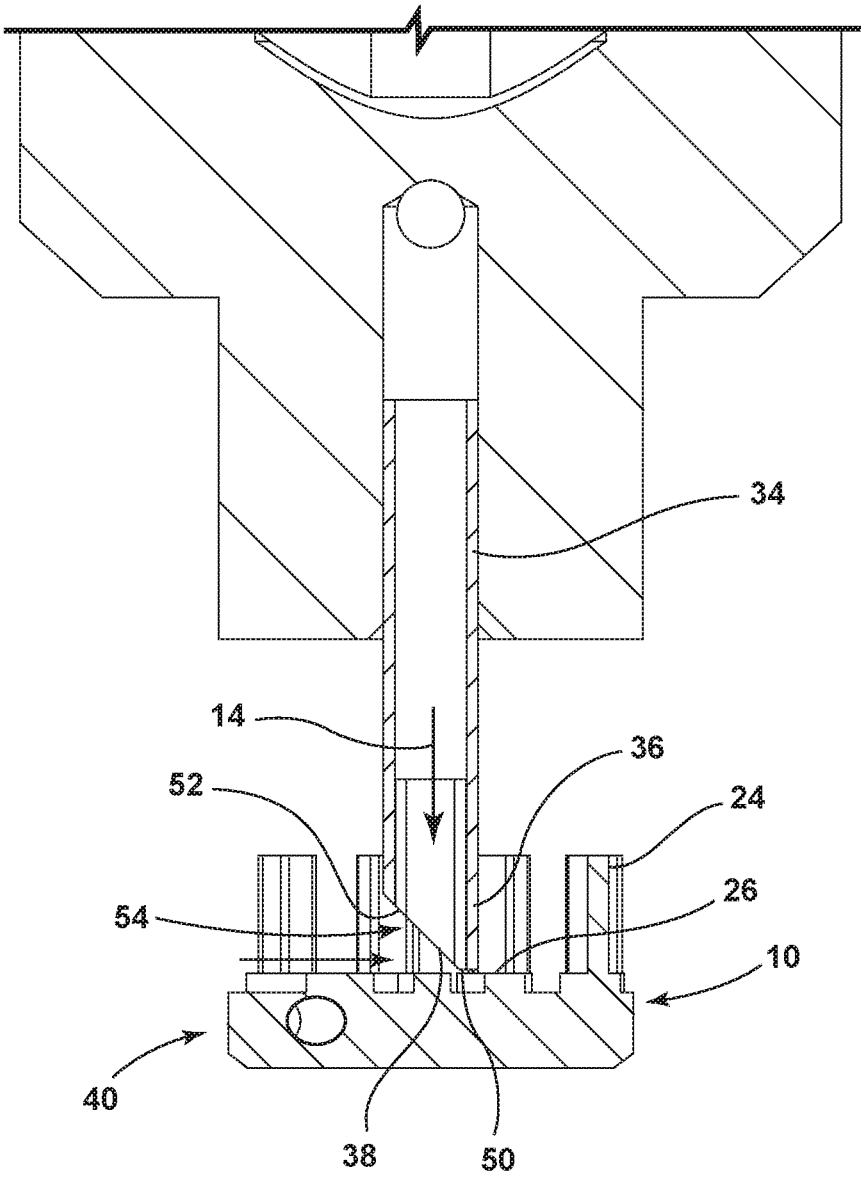
FIG. 24 is a cross-sectional view of the delivery fitting and material delivery port of FIG. 23.

As exemplified schematically in FIGS. 20 and 21, the outward movement 130 and accumulating movement 134 of the viscous material 14 is in the direction of the inner surface 32 of the outer wall 24 and along the inner surface 32 of the outer wall 24 toward the apportioning slots 28. The configuration of the inner surface 32 of the outer wall 24 promotes the smooth and substantially even movement of the viscous material 14 by harnessing the centrifugal force 48 or inertia of the viscous material 14 that is generated through rotation of the delivery fitting 10 and agitation of the viscous material 14 by the receiving slots 90 and the apportioning slots 28. The inner surface 32 of the outer wall 24 serves as an accumulation area 160 where portions of the viscous material 14 can accumulate for ultimate delivery to the inner surface 32 of the tubular substrate 18 via the apportioning slots 28. For particularly viscous materials 14 having a high viscosity and difficult workability, the viscous material 14 may tend to clump or ball into an accumulation of the viscous material 14. In such a condition, the undulating portions 152 of the inner surface 32 may tend to cut away or apportion the clump of viscous material 14 for delivery through the plurality of apportioning slots 28. This configuration allows for the even and regulated flow 46 of the viscous material 14 where such clumping may occur.

Referring again to FIGS. 1-19, the material delivery assembly 12 can be in the form of a rotary tool 170 that is used for dispensing the viscous material 14 onto the interior surface 16 of the tubular substrate 18. This rotary tool 170 for the material delivery assembly 12 can include the receiving surface 26 that includes the plurality of receiving slots 90 that are defined within the receiving surface 26. The outer wall 24 of the rotary tool 170, typically in the form of the delivery fitting 10, extends generally perpendicular from the receiving surface 26 to define the dispersion chamber 30. The plurality of apportioning slots 28 are defined within the outer wall 24 and are configured to regulate the even and regulated flow 46 of viscous material 14 therethrough. The plurality of receiving slots 90 may correspond to a plurality of regulating slots such that each receiving slot 90 terminates at or near a corresponding or respective regulating slot. The receiving slots 90 are configured to at least partially guide the viscous material 14 into and through the apportioning slots 28 during the rotational apportioning state 40 of the receiving surface 26. The rotary tool 170 described herein can take the form of the delivery tool, the drive shaft 22, the drive mechanism and the delivery conduit. This rotary tool 170 can be used as a hand-operated tool, or a machine-controlled tool, that can be activated and deactivated through various controls. These controls can activate and deactivate the drive mechanism and can also activate and deactivate a pump that is configured to deliver the viscous material 14 through the delivery port 36 of the material delivery conduit 34.

An elongated member of the tubular substrate 18 may have a very limited access space for applying the viscous material 14, typically a lubricant or grease. Because of the limitation in space and the high viscosity of the viscous material 14, applying lubricant or grease in these areas can result in uneven spreading of lubricant or grease as well as excessive waste.

In operation, the material delivery assembly 12 deposits the substantially even coating 60 of the viscous material 14 onto the interior surface 16 of the tubular substrate 18. As discussed above, the viscous materials 14 that are dispersed using the material delivery apparatus are typically highly viscous materials 14 that are difficult to apply using conventional means. Using the rotary tool 170 and the delivery fitting 10, these highly viscous materials 14 may be disposed onto relatively small surfaces and within small or confined areas that are disposed within the tubular substrate 18.

As exemplified in FIGS. 1-21, utilizing the material delivery assembly 12 having the rotary tool 170 and the delivery fitting 10, the viscous material 14 can be delivered to the interior surface 16 of the tubular substrate 18 in an expedient fashion and can apply a substantially even coating 60 of a wide range of viscous materials 14 in an efficient manner and with very little waste. As discussed herein, even the highly viscous materials 14 that may be difficult to work with or spread evenly can be manipulated and projected from the delivery fitting 10 in a substantially even and consistent disk-shaped spread pattern 44 that provides an even coating 60 or substantially-even coating 60 of the viscous material 14 on the interior surface 16 of the tubular substrate 18.

Referring now to FIGS. 1-22, having described various aspects of the delivery fitting 10 and the material delivery assembly 12, a method 400 is disclosed for delivering a substantially even layer of a viscous material 14 to an interior surface 16 of a tubular substrate 18. According to the method 400, the highly viscous material 14 is delivered to a rotary tool 170 having an outer wall 24 (step 402). As discussed above, the rotary tool 170 can be in the form of, or can include, the delivery fitting 10 that includes the receiving surface 26 and the outer wall 24. The rotary tool 170 is then rotated to define a biasing centrifugal force 48 that is exerted upon the highly viscous material 14 (step 404). The highly viscous material 14 is then apportioned through a dispersion chamber 30 and along an inner surface 32 of the outer wall 24 of the rotary tool 170 utilizing the biasing centrifugal force 48 (step 406). This apportioning is accomplished through a step 408 of agitating the highly viscous material 14 utilizing a textured receiving surface 26 of the rotary tool 170. Additionally, the rotation of the rotary tool 170 and the textured receiving surface 26 cooperate to bias the highly viscous material 14 in the outward and accumulating movements 130, 134 onto the inner surface 32 of the outer wall 24 (step 410). Through the rotation of the rotary tool 170 and the apportioning of the viscous material 14 through the dispersion chamber 30, the viscous material 14 is projected out from the dispersion chamber 30 via regulating slots of the outer wall 24 utilizing the centrifugal biasing force (step 412). As discussed above, utilizing the apportioning slots 28, the highly viscous material 14 is projected radially through the apportioning slots 28 in a substantially even disk-shaped spread pattern 44. Again, this projection of the highly viscous material 14 includes biasing the highly viscous material 14 from the inner surface 32 of the outer wall 24 and through the apportioning slots 28 that are defined within the outer wall 24. Accordingly, utilizing the angled undulating portions 152 of the inner surface 32 of the outer wall 24, the highly viscous material 14 can move in a substantially even and regulated flow 46 through the apportioning slots 28 to be projected onto the interior surface 16 of the tubular substrate 18.

According to various aspects of the device, as exemplified in FIGS. 1-21, the viscous material 14 can include a wide range of viscosities and self-adhesive characteristics. The viscous material 14 may also include a wide range of adhesion and cohesion characteristics. The operation of the delivery fitting 10 serves to overcome the cohesive properties of the viscous material 14 where the viscous material 14 may tend to stick in clumps or globs. In this manner, the receiving surface 26 and the apportioning slots 28 tend to separate or disperse the viscous material 14 throughout the dispersion chamber 30. The rotational speed of the delivery fitting 10 and the structural formations of the outer wall 24 of the delivery fitting 10 utilize inertia and centrifugal force 48 to also overcome the adhesion characteristics of the viscous material 14. Accordingly, operation of the delivery fitting 10 serves to overcome the cohesive and adhesive characteristics of the viscous material 14 to produce the substantially even and regulated flow 46 of the viscous material 14 through the apportioning slots 28. This regulated flow 46 promotes the disk-shaped spread pattern 44 to deposit the viscous material 14 onto the inner surface 32 of the tubular substrate 18. In this manner, the delivery fitting 10 can utilize the adhesive characteristics of the viscous material 14 to promote a temporary adhesion of the viscous material 14 to the inner surface 32 of the outer wall 24 to generate the regulated flow 46 of the viscous material 14.

Typically, the viscous material 14 utilized for delivery by the material delivery assembly 12 and the delivery fitting 10 is a highly viscous material 14 that may have a wide range of viscosities, measured on a centipoise (cP) scale. The viscosity of the viscous material 14 may typically be in a range of from approximately 1 (cP) to approximately 100,000,000 (cP) or greater viscosities.

Typically, greases and lubricants are highly viscous materials 14 that do not tend to flow easily. These materials typically form globules that may be difficult to spread absent direct physical spreading onto a desired substrate. Utilizing the delivery fitting 10 incorporated within the material delivery assembly 12, the highly viscous materials 14 can be delivered onto the interior surface 16 of the tubular substrate 18 without direct contact with the tubular substrate 18 and can leave an even coating 60 or a substantially even coating 60 of the highly viscous material 14 without the necessity of the additional spreading or physical contact with the highly viscous material 14.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A material delivery assembly comprising:

a delivery fitting attached to a fitting end of a drive shaft, the delivery fitting comprising:

an outer wall that extends perpendicularly from a receiving surface; wherein the receiving surface includes a plurality of receiving slots that radiate outward from a central region of the receiving surface to the outer wall;

a plurality of apportioning slots defined within the outer wall; and a dispersion chamber defined within the outer wall and the receiving surface;

a material delivery conduit that extends to a delivery port located within the dispersion chamber and proximate the receiving surface of the delivery fitting, wherein the delivery port is configured to selectively deliver a viscous material to the receiving surface;

the drive shaft and the delivery fitting selectively and rotationally operate to define an apportioning state of the delivery fitting relative to the delivery port that is configured to manipulate the viscous material toward an inner surface of the outer wall; and the plurality of apportioning slots in the apportioning state are configured to regulate passage of the viscous material from the dispersion chamber, through the outer wall and into a disk-shaped spread pattern.

2. The material delivery assembly of claim 1, wherein the delivery port includes an angled rim and is configured to deliver a viscous material having a high viscosity.

3. The material delivery assembly of claim 1, wherein the receiving slots correspond to the plurality of apportioning slots.

4. The material delivery assembly of claim 3, wherein the receiving slots extend at least partially through the outer wall and define a portion of the apportioning slots.

5. The material delivery assembly of claim 1, wherein the receiving slots have a first width, and the apportioning slots have a second width that is different than the first width.

6. The material delivery assembly of claim 1, wherein the receiving surface includes a primary receiving area and a secondary receiving area, that defines a textured configuration of the receiving surface.

7. The material delivery assembly of claim 6, wherein the secondary receiving area defines the receiving slots of the receiving surface.

8. The material delivery assembly of claim 1, wherein the receiving slots are oriented in a generally spiral-type configuration.

* * * * *